US010089918B2

(12) United States Patent
Kwon et al.

(10) Patent No.: US 10,089,918 B2
(45) Date of Patent: Oct. 2, 2018

(54) DISPLAY DEVICE

(71) Applicant: SILICON WORKS CO., LTD., Daejeon (KR)

(72) Inventors: Yong Jung Kwon, Cheongju-si (KR); Jeong Bae Yun, Daejeon-si (KR); Jeung Hie Choi, Cheongju-si (KR)

(73) Assignee: SILICON WORKS CO., LTD., Daejeon (KR)

( * ) Notice: Subject to any disclaimer, the term of this patent is extended or adjusted under 35 U.S.C. 154(b) by 24 days.

(21) Appl. No.: 15/240,061

(22) Filed: Aug. 18, 2016

(65) Prior Publication Data

US 2017/0053598 A1 Feb. 23, 2017

(30) Foreign Application Priority Data

Aug. 20, 2015 (KR) ..... 10-2015-0117125

(51) Int. Cl.

| | |
|---|---|
| ***G09G 3/3275*** | (2016.01) |
| ***G09G 3/20*** | (2006.01) |
| ***G09G 3/3233*** | (2016.01) |
| ***G09G 3/3291*** | (2016.01) |
| ***G09G 5/00*** | (2006.01) |

(52) U.S. Cl.

CPC ..... *G09G 3/2096* (2013.01); *G09G 3/3233* (2013.01); *G09G 3/3291* (2013.01); *G09G 5/008* (2013.01); *G09G 2310/027* (2013.01); *G09G 2310/0294* (2013.01); *G09G 2310/08* (2013.01);

(Continued)

(58) Field of Classification Search

CPC ..... G09G 3/3275; G09G 2310/08; G09G 2310/0294; G09G 2310/027; G09G 3/2096; G09G 3/3233; G09G 3/3291; G09G 5/008; G09G 2320/029; G09G 2320/043; G09G 2370/10

See application file for complete search history.

(56) References Cited

U.S. PATENT DOCUMENTS

2004/0227716 A1* 11/2004 Lin ..... G09G 3/3648 345/99
2008/0204388 A1* 8/2008 Lee ..... G09G 3/3611 345/87

(Continued)

FOREIGN PATENT DOCUMENTS

| | | |
|---|---|---|
| KR | 10-2011-0021386 | 3/2011 |
| KR | 10-2013-0051182 | 5/2013 |
| KR | 0-2015-0109569 | 10/2015 |

*Primary Examiner* — Md Saiful A Siddiqui
(74) *Attorney, Agent, or Firm* — Kile Park Reed & Houtteman PLLC

(57) ABSTRACT

Disclosed is a display device capable of assigning unique information to a plurality of source drivers and easily controlling an operation sequence and operation time. The display device may include: a timing controller configured to generate an input signal having a clock signal embedded between data signals each including a pixel data packet and a control data packet, and provide the input signal to a source driver; and a source driver configured to receive the input signal, sense pixel information of a display panel, and enabled to transmit the pixel information to the timing controller in response to preset information contained in the control data packet, and configured to transmit the pixel information to the timing controller during an operation time corresponding to operation time information contained in the control data packet.

14 Claims, 3 Drawing Sheets

(52) U.S. Cl.
CPC . *G09G 2320/029* (2013.01); *G09G 2320/043* (2013.01); *G09G 2370/10* (2013.01)

(56) References Cited

U.S. PATENT DOCUMENTS

| | | | | |
|---|---|---|---|---|
| 2010/0156879 | A1* | 6/2010 | Hong | G09G 3/3648 345/213 |
| 2011/0037758 | A1* | 2/2011 | Lim | H03L 7/0805 345/213 |
| 2011/0122119 | A1* | 5/2011 | Bae | G09G 3/3233 345/211 |
| 2014/0049532 | A1* | 2/2014 | Choi | G09G 5/00 345/213 |

* cited by examiner

DISPLAY DEVICE

CROSS REFERENCE TO RELATED APPLICATIONS

This application claims the priority to and the benefit of Korean Patent Application No. 10-2015-0117125 filed on Aug. 20, 2015 in the Korean Intellectual Property Office, the disclosures of which are incorporated herein by reference for all purposes.

BACKGROUND

1. Technical Field

The present disclosure relates to a display device, and more particularly, to a display device which is capable of easily controlling an operation sequence and operation time by assigning unique information to a plurality of source drivers.

2. Related Art

In general, a display device includes a display panel, a gate driver, a source driver and a timing controller.

The display panel includes a gate line and a data line, the gate driver supplies a gate driving voltage to the gate line, and the source driver supplies a data voltage to the data line. The timing controller provides a data signal to the source driver.

The source driver converts the data signal provided from the timing controller into a data voltage, and provides the data voltage to the display panel.

The source driver includes a digital-to-analog converter (DAC) configured to convert a data signal provided from the timing controller into a data voltage, and an output circuit configured to output the data voltage to the display panel.

The display device provides pixel information which a plurality of source drivers sense from the display panel, to the timing controller, using the carry input/output scheme. When a carry signal is inputted, each of the source drivers transmits pixel information to the timing controller. When the transmission is completed, the source driver outputs a carry signal to the next source driver to transmit pixel information.

Since the display device uses the carry input/output scheme, the operation sequence and operation time of the plurality of source drivers cannot be controlled. Thus, there is a demand for a device which is capable of controlling the operation sequence and operation time of a plurality of source drivers.

SUMMARY

Various embodiments are directed to a display device capable of assigning unique information to a plurality of source drivers and easily controlling an operation sequence and operation time.

Also, various embodiments are directed to a display device capable of excluding a signal line for carry input/output.

In an embodiment, a display device may include: a timing controller configured to generate an input signal having a clock signal embedded between data signals each including a pixel data packet and a control data packet, and provide the input signal to a source driver; and a source driver configured to receive the input signal, sense pixel information of a display panel, and enabled to transmit the pixel information to the timing controller in response to preset information contained in the control data packet, and configured to transmit the pixel information to the timing controller during an operation time corresponding to operation time information contained in the control data packet.

In an embodiment, a display device may include: a timing controller configured to assign unique information to a plurality of source drivers, respectively, and provide a control data packet to the respective source drivers, the control data packet containing the unique information and at least one of sequence information and operation time information; and the plurality of source drivers configured to recover the control data packet, selectively enabled in response to at least one of the unique information and the sequence information, and configured to provide pixel information sensed from a display panel to the timing controller during an operation time corresponding to the operation time information.

DETAILED DESCRIPTION

Figure 1:
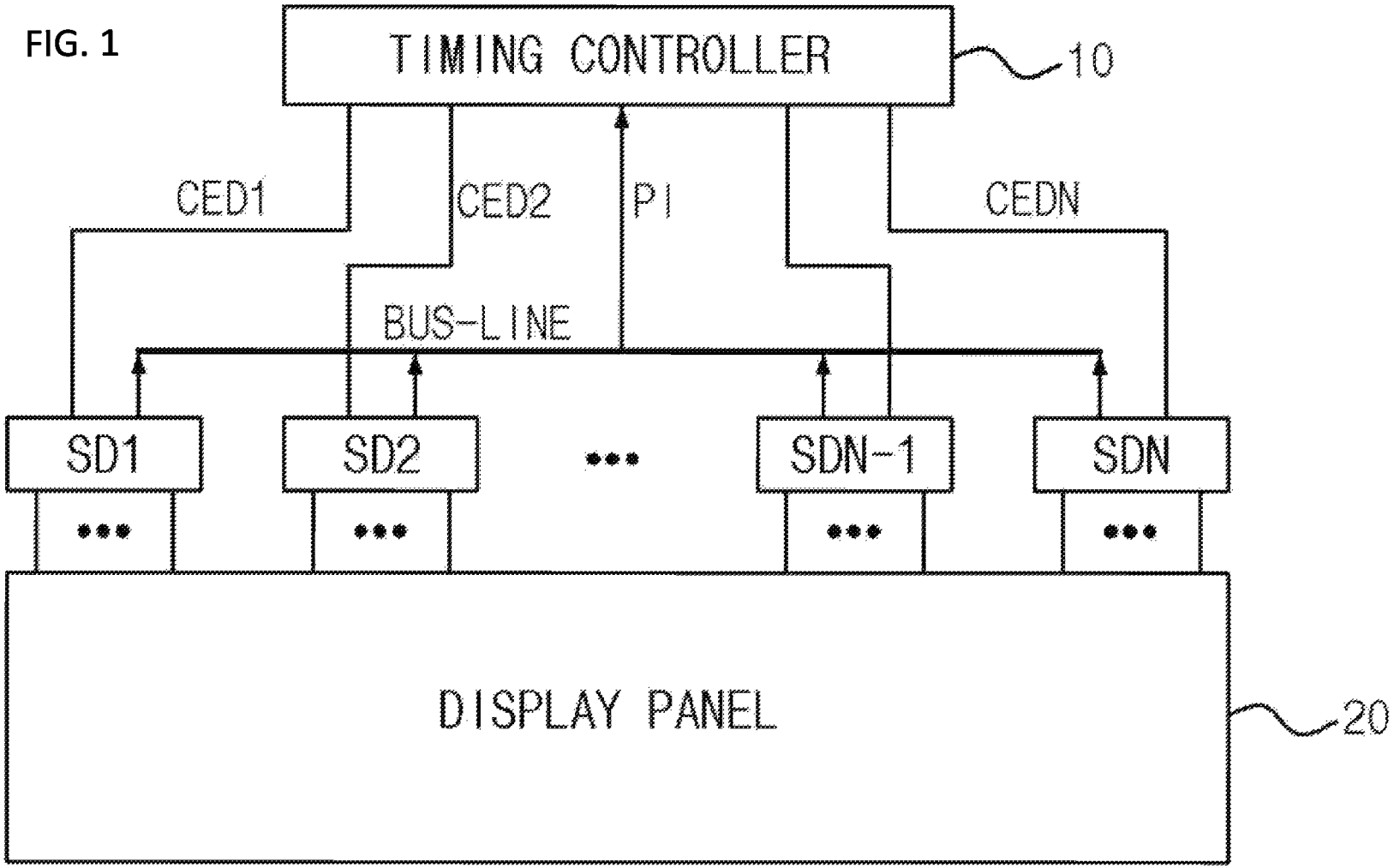
FIG. 1 is a block diagram illustrating a display device according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 is a block diagram illustrating a display device according to an embodiment of the present invention.

Referring to FIG. 1, the display device according to the embodiment of the present invention includes a timing controller 10, a plurality of source drivers SD1 to SDN and a display panel 20.

The timing controller 10 provides input signals CED1 to CEDN to the plurality of source drivers SD1 to SDN. The input signals CED1 to CEDN may be provided through a CEDS (Clock Embedded Data Signaling) protocol in which a clock signal is embedded between data signals. The data signal may include a pixel data packet and a control data packet CP. The pixel data packet may include pixel data RWGB, and the control data packet CP may include at least one of control information for converting pixel data into a source driving signal to drive the display panel, unique information for identifying the source drivers SD1 to SDN, sequence information for determining an operation sequence to transmit the pixel information, and operation time information for transmitting pixel information PI of the source drivers SD1 to SDN.

In the present embodiment, a part of the control data packet CP may be used as the unique information for identifying the source drivers SD1 to SDN or the sequence information for determining an operation sequence to transmit the pixel information.

For example, at least one specific bits of the control data packet CP may be used as the unique information for identifying the source drivers SD1 to SDN or the sequence information for determining an operation sequence to transmit the pixel information. When the specific bits are 'LLLL', the source driver SD1 may be selected, when the specific bits are 'LLLH', the source driver SD2 may be selected, when the specific bits are 'LLHL', the source driver SD3 may be selected, and when the specific bits are 'HHHH', the source driver SD16 may be selected.

In this way, the display device according to the present embodiment may set the operation sequence such that the source drivers SD1 to SDN are sequentially selected, the operation sequence such that the source drivers SD1 to SDN are selected with an interval provided therebetween, or set the operation sequence such that the source drivers SD1 to SDN are selected while the operations thereof overlap each other. That is, the display device can easily change the operation sequence of the source drivers SD1 to SDN.

In the present embodiment, a part of the control data packet CP may be used as the operation time information for transmitting pixel information of the source drivers SD1 to SDN.

For example, at least one specific bits of the control data packet CP may be used as the operation time information for transmitting the pixel information. In this case, when the specific bits are 'LL', the pixel information may be transmitted during ¼ cycle of a recovered clock signal. When the specific bits are 'LH', the pixel information may be transmitted during a half cycle of the recovered clock signal. When the specific bits are 'HL', the pixel information may be transmitted during one cycle of the recovered clock signal. When the specific bits are 'HH', the transmission of the pixel information may be stopped.

In this way, the display device according to the present embodiment can determine the operation time indicating whether to transmit the pixel information of the source drivers SD1 to SDN during ¼ cycle, a half cycle or one cycle of the clock signal, and easily control the operation time. The operation time information may be set in such a manner that each of the source drivers SD1 to SDN has the same or different operation time.

The input signals CED1 to CEDN may be transmitted through a differential signaling method or single-ended signaling method, and the clock signals and data signals included in the input signals CED1 to CEDN may have the same level of amplitude.

The input signals CED1 to CEDN are transmitted in different formats for a CT (Clock Training) section and a data transmission section. The input signals CED1 to CEDN have a format that contains only a clock signal in the CT section and a format that contains a clock signal embedded between data signals in the data transmission section.

The timing controller 10 may include the control data packet CP in the input signals CED1 to CEDN and transmit the input signals CED1 to CEDN to the source drivers SD1 to SDN through the CEDS protocol, the control data packet CP containing at least one of the unique information, the sequence information and the operation time information on the source drivers SD1 to SDN. In the present embodiment, the timing controller 10 transmits the input signals CED1 to CEDN including the control data packet CP. However, the control data packet CP may be provided to the source drivers SD1 to SDN through a separate control line (not illustrated).

The source drivers SD1 to SDN recover a data signal and a clock signal from the input signals CED1 to CEDN, convert pixel data RWGB included in the data signal into a data voltage, and provide the data voltage to the display panel 20.

The source drivers SD1 to SDN sense the pixel information PI of the display panel 20, and provide the pixel information PI to the timing controller 10 through a common transmission line BUS-LINE in response to the control data packet CP contained in the data signal. The common transmission line BUS-LINE is shared by the source drivers SD1 to SDN.

As a result, the source drivers SD1 to SDN occupy the common transmission line BUS-LINE using at least one of the unique information, the sequence information and the operation time information which are included in the control data packet CP. For example, the source drivers SD1 to SDN may sequentially occupy the common transmission line, occupy the common transmission line with an interval provided therebetween, or occupy the common transmission line while the operations thereof overlap each other, in response to the unique information or sequence information.

The internal configuration of the source drivers SD1 to SDN will be described as follows. For convenience of description, the descriptions of the source driver SD1 may replace the descriptions of the other source drivers SD2 to SDN.

Figure 2:
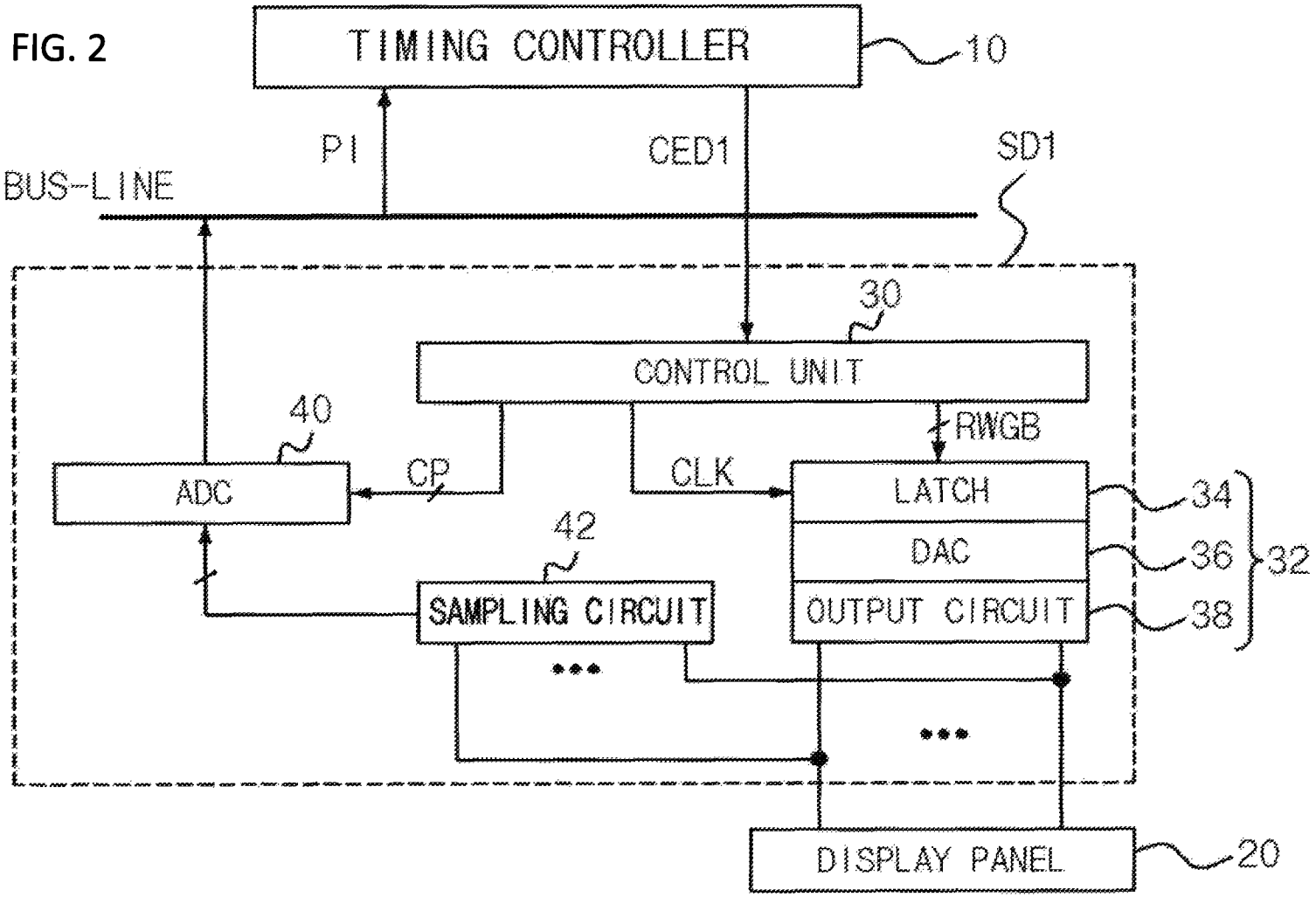
FIG. 2 is a block diagram illustrating a source driver of FIG. 1.

FIG. 2 is a block diagram illustrating the source driver SD1 of FIG. 1.

Referring to FIG. 2, the source driver SD1 includes a control unit 30, a data conversion unit 32, a sampling circuit 42 and an ADC (Analog to Digital Converter) 40.

The control unit 30 recovers a data signal from the input signal CED1, and recovers a clock signal from the input signal CED1, the data signal including a pixel data packet and a control data packet CP.

The control unit 30 provides the pixel data packet and the clock signal to the data conversion unit 32, and provides the control data packet CP to the ADC 40. For example, the control unit 30 may include a clock signal recovery unit (not illustrated) for recovering the clock signal and a data recovery unit (not illustrated) for recovering the data signal in response to a sampling clock signal generated through the clock signal recovery unit. The control unit 30 may include a counter (not illustrated) for counting an operation time.

The data conversion unit 32 includes a latch 34, a DAC (Digital to Analog Converter) 36 and an output circuit 38. The latch 34 of the data conversion unit 32 latches the pixel data packet recovered through the control unit 30, and provides the latched packet to the DAC 36. The DAC 36 converts the pixel data packet into a data voltage, and provides the data voltage to the output circuit 38. The output circuit 38 buffers the data voltage and outputs the buffered voltage to the display panel 20.

The sampling circuit 42 senses the pixel information PI of the display panel 20, and provides the pixel information PI to the ADC 40. The pixel information PI may include a pixel voltage. The pixel voltage is used for compensation of the display panel 20.

For example, when the display panel 20 is implemented with an OLED panel, the OLED panel includes a driving transistor and an OLED for each pixel. When the data voltage is applied to turn on the driving transistor, the OLED emits light. The driving transistor may have a threshold voltage Vth, and the threshold voltages of the driving transistors of the respective pixels may be different from each other. Thus, although the same data voltage is applied, the currents of the driving transistors of the respective pixels may be different from each other, due to the threshold voltage difference therebetween. Furthermore, the respective pixels may have different luminance due to the threshold voltage difference therebetween. In order to compensate for the difference, the pixel voltage sensed by the sampling circuit 42 is used for calculating the threshold voltages of a driving transistor, and the threshold voltage is used for compensation of the display panel 20.

The ADC 40 converts the pixel information PI sensed through the sampling circuit 42 into a digital signal, and provides the pixel information PI into the timing controller 10 in response to the control data packet CP. The ADC 40 is enabled in response to the unique information for identifying the source drivers SD1 to SDN or the sequence information for determining an operation sequence to transmit the pixel information, which is included in the control data packet CP, and transmits the pixel information PI to the timing controller 10 during a predetermined cycle of the recovered clock signal in response to the operation time information of the source drivers SD1 to SDN, which is included in the control data packet CP.

As such, the source driver SD1 is enabled according to the unique information or sequence information included in the control data packet CP, without using the carry input/output scheme, and provides the pixel information PI to the timing controller 10 according to the operation time information included in the control data packet CP. The other source drivers SD2 and SDN are also enabled according to the unique information or sequence information included in the control data packet CP, and provide the pixel information PI to the timing controller 10 according to the operation time information included in the control data packet CP.

Thus, since the plurality of source drivers SD1 to SDN are selectively enabled and operated according to the unique information or sequence information included in the control data packet CP, the source drivers SD1 to SDN can be separately controlled, and the operation sequence can be easily changed.

Furthermore, since the display device can determine the operation time according to the operation time information included in the control data packet CP and provide the pixel information PI to the timing controller 10 according to the operation time information, the display device can easily control the operation time.

Furthermore, since the unique information, the sequence information or the operation time information is included in the control data packet CP, a separate carry signal line for carry input/output can be excluded.

In the present embodiment, the display device may provide the pixel information PI which the source drivers SD1 to SDN sense from the display panel 20. However, the display device may provide the state information of the source drivers SD1 to SDN.

Furthermore, the display device can change the operation sequence and operation time using the unique information or sequence information included in the data packet CP, and provide the pixel information PI to the timing controller 10. For example, the display device can change the operation sequence and operation time such that the source drivers SD1 to SDN are sequentially operated, operated with an internal therebetween, or operated while the operations thereof overlap each other.

When the source drivers SD1 to SDN are sequentially operated, specific bits of the control data packet CP for identifying the source drivers SD1 to SDN may be sequentially provided in the form of 'LLLL', 'LLLH' to 'HHHH', such that the source drivers SD1 to SDN are sequentially selected.

Furthermore, when the source drivers SD1 to SDN are operated with an interval provided therebetween, specific bits of the control data packet CP for identifying the source drivers SD1 to SDN may be provided in the form of 'LLLL', 'LLHL' or 'LHLL' or provided in the form of 'LLLL', 'LLHH' or 'LHLH', such that the source drivers SD1 to SDN are selected with an interval provided therebetween.

Figure 3:
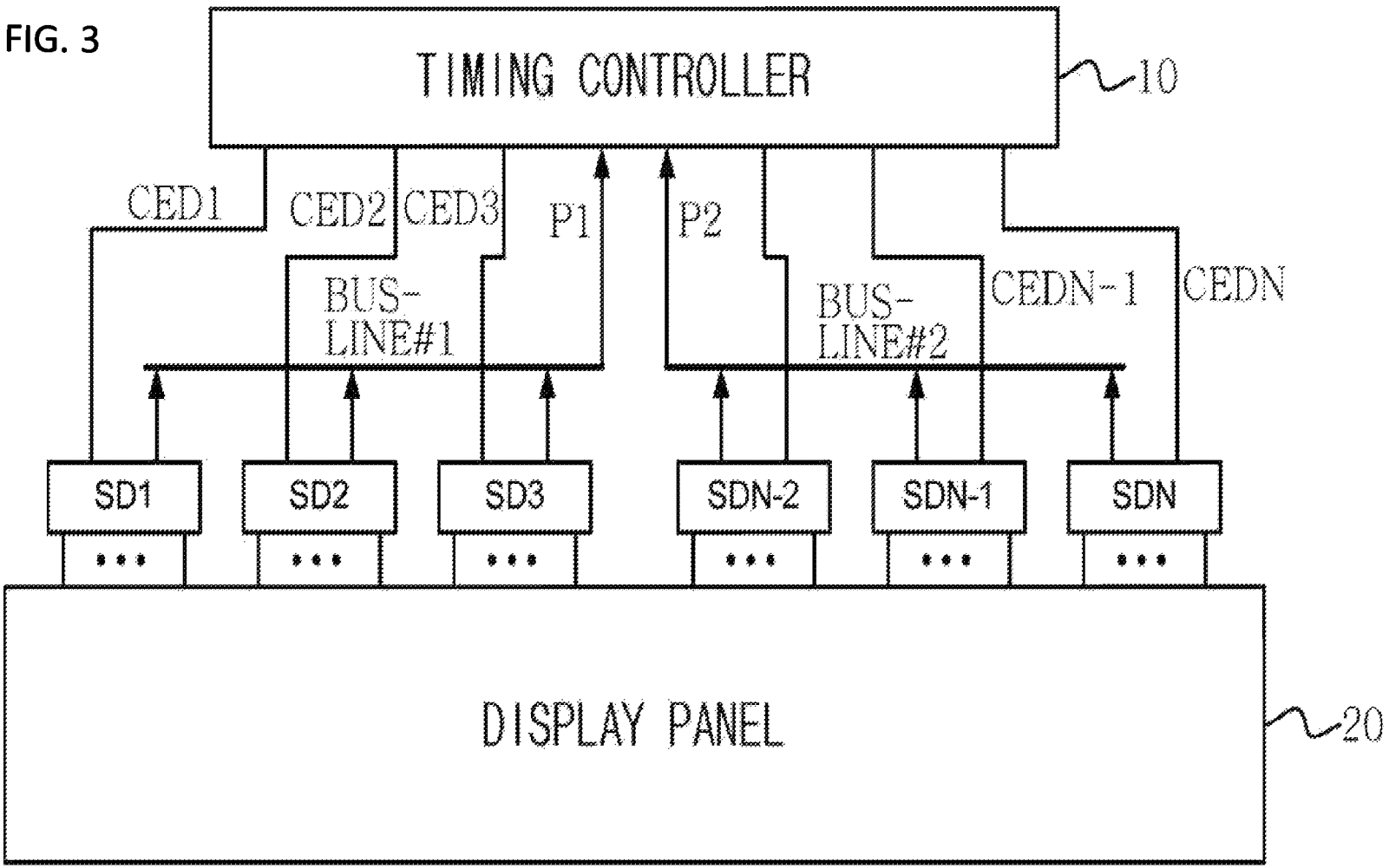
FIG. 3 is a block diagram illustrating a display device according to another embodiment of the present invention.

FIG. 3 is a block diagram illustrating a display device according to another embodiment of the present invention. Specifically, FIG. 3 illustrates a display device which includes a plurality of common transmission lines BUS-LINE in order to increase a data transmission rate and operates the source drivers SD1 to SDN such that the operations thereof overlap each other.

Referring to FIG. 3, the display device may provide a control data packet CP for identifying the source drivers SD1 to SDN to a first group of source drivers and a second group of source drivers, which are connected to common transmission lines BUS-LINE#1 and BUS-LINE#2, respectively, at the same time. Thus, the source drivers SD1 to SDN of the first and second groups may be operated at the same time, while the operations thereof overlap each other.

Specifically, specific bits of the control data packet CP may be provided as 'LLLL' to the source drivers SD1 and SDN-2 and provided as 'LLLH' to the source drivers SD2 and SDN-1, in order to identify the source drivers SD1 to SDN. Then, the pixel information PI can be received through the common bus lines BUS-LINE#1 and BUS-LINE#2 at the same time. FIG. 3 illustrates two common transmission lines, but the present invention is not limited thereto.

Since the unique information for identifying the source drivers SD1 to SDN or the sequence information for determining an operation sequence to transmit the pixel information is contained in the control data packet CP, the display device according to the present embodiment may easily change the operation sequence of the source drivers SD1 to SDN. In the present embodiment, the data signal containing the control data packet CP is transmitted. However, the data signal may be provided to the source drivers SD1 to SDN through a separate control line (not illustrated).

According to the present embodiment, since pixel information is provided to the timing controller in response to the control data packet including the unique information or sequence information or the operation time information of the source drivers, the display device can exclude a signal line for carry input/output.

Furthermore, the display device can separately control the plurality of drivers, and easily control the operation sequence and operation time.

While various embodiments have been described above, it will be understood to those skilled in the art that the embodiments described are by way of example only. Accordingly, the disclosure described herein should not be limited based on the described embodiments.

What is claimed is:

1. A display device comprising:

a timing controller circuitry configured to generate an input signal having a clock signal embedded between data signals each including a pixel data packet and a control data packet, and provide the input signal to a plurality of source drivers; and the plurality of source drivers configured to receive the input signal, sense pixel information from a display panel, and enabled to transmit the pixel information to the timing controller circuitry in response to unique information for identifying the plurality of source drivers contained in the control data packet, and configured to transmit the pixel information to the timing controller circuitry during an operation time corresponding to operation time information for determining the operation time contained in the control data packet, wherein the respective plurality of source drivers comprises:

a sampling circuit configured to sense the pixel information from the display panel; and an Analog-to-Digital Converter (ADC) configured to be enabled in response to the unique information in the control data packet and transmit the pixel information sensed from the display panel by the sampling circuit to the timing controller circuitry during the operation time, the operation time being determined by the operation time information in the control data packet.

2. The display device of claim 1, wherein the control data packet comprises at least one of the unique information for identifying the plurality of source drivers, sequence information for determining an operation sequence to transmit the pixel information, and the operation time information for determining the operation time based on the cycle of the clock signal.

3. The display device of claim 1, wherein the operation time information is set to be controlled for the respective the plurality of source drivers.

4. The display device of claim 3, wherein the respective plurality of source drivers further comprises:

a control unit circuitry configured to recover the data signal and the clock signal from the input signal.

5. The display device of claim 1, further comprising a common transmission line shared by the plurality of source drivers, wherein the plurality of source drivers occupies the common transmission line in response to the unique information, and provides the pixel information to the timing controller circuitry through the common transmission line during the operation time.

6. The display device of claim 5, wherein the plurality of source drivers sequentially occupies the common transmission line in response to the unique information, occupies the common transmission line with an interval from another source driver, or occupies the common transmission line while the operation thereof overlaps the operation of another source driver.

7. The display device of claim 5, wherein the plurality of source drivers occupies the common transmission line during a predetermined cycle of the clock signal corresponding to the operation time information, in order to transmit the pixel information.

8. The display device of claim 1, further comprising:

a first common transmission line shared by a first group of the plurality of source drivers; and a second common transmission line shared by a second group of the plurality of source drivers, wherein the first and second groups of the plurality of source drivers are configured to occupy the first and second common transmission lines, respectively, in response to at least one of unique information and sequence information which are the preset information.

9. The display device of claim 8, wherein the first and second groups of the plurality of source drivers are configured to simultaneously provide the pixel information while the operations thereof overlap each other.

10. A display device comprising:

a timing controller circuitry configured to assign unique information for identifying a plurality of source drivers, respectively, and provide a control data packet to the respective source drivers, the control data packet containing at least one of the unique information, sequence information and operation time information; and the plurality of source drivers configured to recover the control data packet, selectively enabled in response to at least one of the unique information and the sequence information, and configured to provide pixel information sensed from a display panel to the timing controller circuitry during an operation time corresponding to the operation time information for determining the operation time, wherein the respective plurality of source drivers comprises:

a sampling circuit configured to sense the pixel information from the display panel; and an Analog-to-Digital Converter (ADC) configured to be enabled in response to the unique information in the control data packet and transmit the pixel information sensed from the display panel by the sampling circuit to the timing controller circuitry during the operation time, the operation time being determined by the operation time information in the control data packet.

11. The display device of claim 10, wherein the timing controller circuitry is configured to provide the control data packet to the source drivers through a separate control line.

12. The display device of claim 10, wherein the plurality of source drivers provide the pixel information to the timing controller circuitry through a common transmission line, and occupy the common transmission line in response to at least one of the unique information and the sequence information.

13. The display device of claim 12, further comprising first and second common transmission lines, wherein the first common transmission line is shared by a first group among the plurality of source drivers, and the second common transmission line is shared by a second group among the plurality of source drivers.

14. The display device of claim 13, wherein the source drivers of the first and second groups occupy the first and second common transmission lines in response to at least one of the unique information and the sequence information, and simultaneously provide the pixel information to the timing controller circuitry while the operations thereof overlap each other.

* * * * *